United States Patent [19]

Blyweert

[11] 4,024,680

[45] May 24, 1977

[54] PREFABRICATED STRUCTURE FOR ERECTING A BUILDING

[75] Inventor: Pierre J. Blyweert, Brussels, Belgium

[73] Assignee: Lera Holding S.A., Luxembourg

[22] Filed: May 24, 1976

[21] Appl. No.: 689,631

[30] Foreign Application Priority Data

May 27, 1975 Luxembourg ..... 72586

[52] U.S. Cl. ..... 52/18; 52/70; 52/71; 52/81; 52/582

[51] Int. Cl.[2] ..... E04B 7/12; E04B 1/344

[58] Field of Search ..... 52/64, 18, 71, 70, 406, 52/582, 615, 81

[56] References Cited

UNITED STATES PATENTS

| | | | |
|---|---|---|---|
| 2,271,575 | 2/1942 | Waterman | 52/406 X |
| 3,346,998 | 10/1967 | Nelson | 52/70 |
| 3,389,514 | 6/1968 | Horvath | 52/71 X |
| 3,394,526 | 7/1968 | Engelbrecht | 52/18 X |
| 3,407,546 | 10/1968 | Yates et al. | 52/18 |
| 3,443,344 | 5/1969 | Williams | 52/18 |
| 3,466,830 | 9/1969 | Smith | 52/71 X |
| 3,481,087 | 12/1969 | Stafford | 52/615 X |
| 3,524,288 | 8/1970 | Coppa | 52/71 X |
| 3,531,851 | 10/1970 | Douglas | 52/71 X |
| 3,629,982 | 12/1971 | Ballay et al. | 52/71 X |
| 3,646,718 | 3/1972 | McKenna | 52/81 X |
| 3,759,277 | 9/1973 | Glade | 52/71 X |
| 3,854,266 | 12/1974 | Solas | 52/71 X |
| 3,921,349 | 11/1975 | Kolozsvary | 52/81 |

FOREIGN PATENTS OR APPLICATIONS

| | | | |
|---|---|---|---|
| 701,301 | 12/1940 | Germany | 52/18 |
| 455,216 | 10/1968 | Switzerland | 52/70 |
| 1,215,573 | 12/1970 | United Kingdom | 52/18 |
| 1,343,436 | 1/1974 | United Kingdom | 52/71 |
| 1,234,401 | 6/1971 | United Kingdom | 52/71 |

*Primary Examiner*—Leslie Braun
*Attorney, Agent, or Firm*—Bacon & Thomas

[57] ABSTRACT

There is described a prefabricated structure for erecting a building, that comprises bays hinged together which can take a position with a reduced volume and a position of extension, in which each bay comprises in the structure erecting condition and from the geometrical point-of-view, two pairs of dihedrons facing one another by pairs and comprising respectively the roof, the underflooring and the frontages of the bay, each dihedron comprising two sides hinged together along the dihedron intersection line and the junction areas between the dihedrons are each comprised of a truncated polyhedron comprising four side surfaces hinged together along their converging edges, said edges converging towards an apex located outside the imaginary right angle between the intersection lines of two dihedrons, two of those edges opposite the converging edges of the polyhedron being hingedly joined to one of the dihedrons, the structure further comprising means for stabilizing the dihedron angles in the bay extension condition, and the succeeding bays being hingedly connected together along the adjacent circumferential edges thereof.

14 Claims, 21 Drawing Figures

PREFABRICATED STRUCTURE FOR ERECTING A BUILDING

This invention relates to a prefabricated structure for erecting a building, that comprises bays hinged together which can take a position with a reduced volume and a position of extension.

There have been proposed up to now prefabricated roofs which take for the conveying the shape of a series of elements or bays which are hinged in zig-zag fashion and folded back against one another, said elements being spread out on the building site. Such a structure can be but a very partial solution to the modern trend of erecting buildings from prefabricated elements.

This invention has for object to provide a prefabricated structure comprising all of the parts bounding the building on the outside, that is the frontages, the roof and the under-flooring. This invention has for object to provide a structure of this kind which in the reduced-volume condition allows to reduce the volume thereof by about 85% relative to the volume in erected condition; the structure conveying problem is thereby made much easier; the structure according to the invention has moreover the advantage of a simple and fast erecting.

This invention has also for object to provide a prefabricated structure which as regards the architectonic design, is original and has the large advantage of allowing to obtain a heightening of the underflooring which leaves the ground surface free to arrange parking areas or sale areas or even a commercial center.

Another object of the invention is to allow more freedom in the plane covered by the structure, such plane may be straight or curved.

For this purpose according to the invention, each bay comprises in the structure erecting condition and from the geometrical point-of-view, two pairs of dihedrons facing one another by pairs and comprising respectively the roof, the underflooring and the frontages of the bay, each dihedron comprising two sides hinged together along the dihedron intersection line and the junction areas between the dihedrons are each comprised of a truncated polyhedron comprising four side surfaces hinged together along their converging edges, said edges converging towards an apex located outside the imaginary right angle between the intersection lines of two dihedrons, two of those edges opposite the converging edges of the polyhedron being hingedly joined to one of the dihedrons, the structure further comprising means for stabilizing the dihedron angles in the bay extension condition, and the succeeding bays being hingedly connected together along the adjacent circumferential edges thereof.

Two practical embodiments of the structure are preferred according to the invention:

In the first embodiment, the sides of the dihedrons and polyhedrons are comprised of rigid panels and said panels are connected together along the adjacent edges thereof by means of flexible connecting sectional shapes, the panels and the connecting sectional shapes forming a monocoque structure.

In the second embodiment, the structure comprises a series of skeleton frames housing the circumference of the dihedrons and the polyhedron sides, rigid panels for filling said frames as well as members for hingedly connecting the frames together.

Other details and features of the invention will stand out from the description given below by way of non limitative example and with reference to the accompanying drawings, in which:

FIGS. 1 to 3 diagrammatically show the geometry of three prefabricated structures for building according to the invention, in the extension condition.

In the various figures, the same reference numerals pertain to similar elements.

Reference will first be made to FIGS. 1 to 6 which show diagrammatically the geometry of the prefabricated structure according to the invention.

Figure 1:
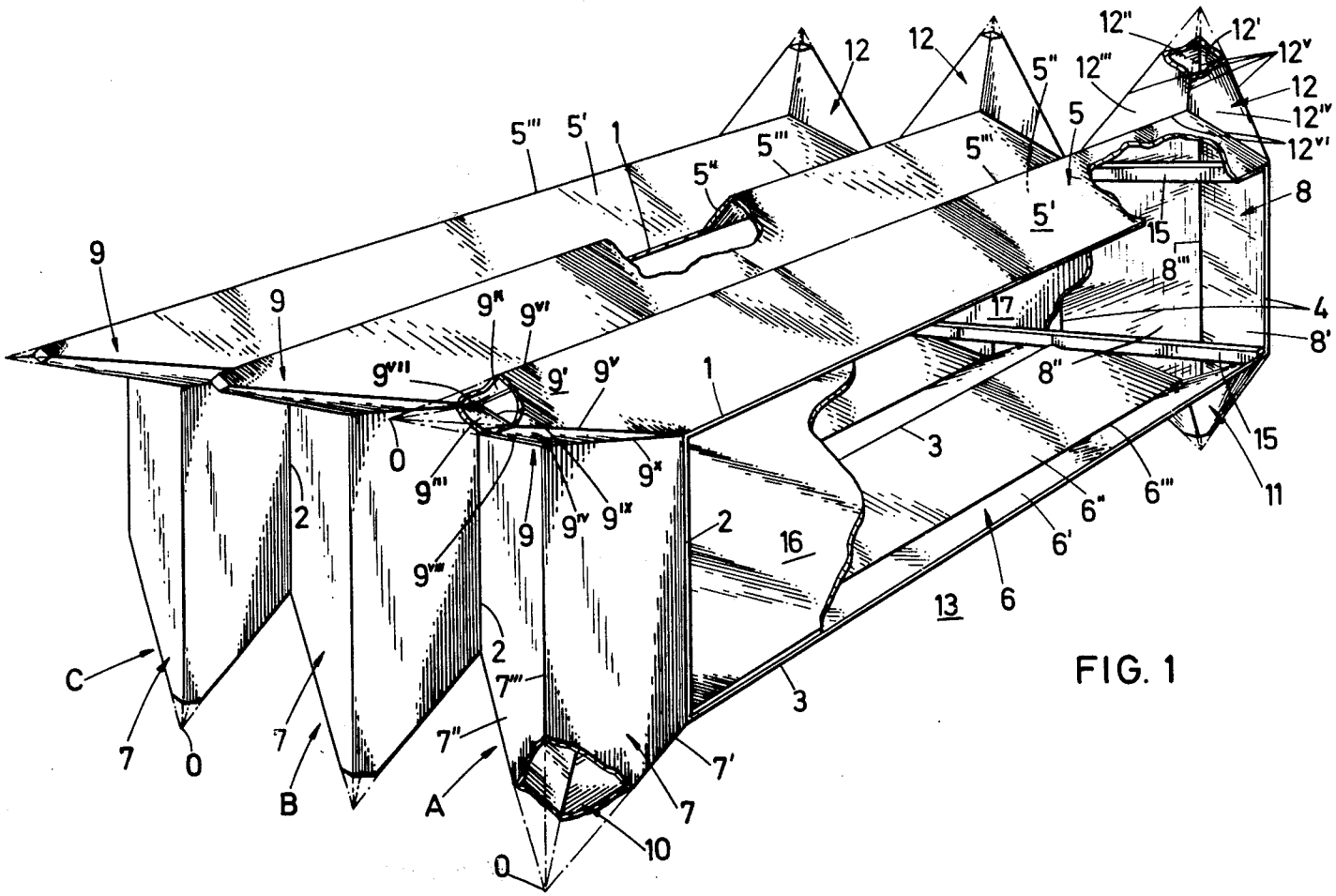

As shown in FIG. 1, the structure according to the invention comprises a number, to be determined according to the required usable volume, of bays A, B, C, . . . , hinged together along the circumferential edges 1 to 4 thereof. Each bay A, B, C is essentially comprised of two pairs of dihedrons facing one another two by two, 5 to 8; the dihedrons 5 and 6 comprise respectively the roof and the underflooring of the bay, while the dihedrons 7 and 8 comprise the frontages of the bay. Each one of the dihedrons comprises two sides designated by [$^{I}$] and [$^{II}$] which are hinged together along the dihedron intersection line designated by [$^{III}$].

The converging dihedrons 5,7; 7,6; 6,8 and 8,5 are connected together by junction areas 9 to 12. Each junction area is comprised of a truncated polyhedron with four side surfaces designated respectively by [$^{I}$], [$^{II}$], [$^{III}$] and [$^{IV}$], hinged together along the converging edges thereof directed towards an apex O and designated by [$^{V}$ to $^{VIII}$]. On the opposite side, two polyhedron sides, [$^{I}$] and [$^{II}$] are connected without discontinuity to those dihedron sides they actually extend in the same plane, while both other polyhedron sides, [$^{III}$] and [$^{IV}$] are located in a plane cross-wise to the dihedron sides to which they are connected and this along a hinged edge [$^{IX}$] and [$^{X}$].

Instead of the above definition regarding the junction area, it is also possible to state that said junction area results from an extension of the one dihedron, for instance dihedron 5 for junction area 9, the edges of which lying in the extension of the edges 1, $9^{V}$ and $9^{VIII}$ form together with the intersection line $9^{VI}$ a truncated triangle the apex of which is O, and from the hinged association with edges $9^{V}$ and $9^{VI}$ of said extension, of a complementary dihedron comprised of sides $9^{III}$ and $9^{IV}$, said sides lying in planes cross-wise to the planes of sides $7^{I}$ and $7^{II}$ of the second dihedron 7 concerned by the junction area; the intersection line $9^{VIII}$ as well as the opposite edges $9^{IX}$ and $9^{X}$ of the complementary dihedron are hinged.

Figure 2:
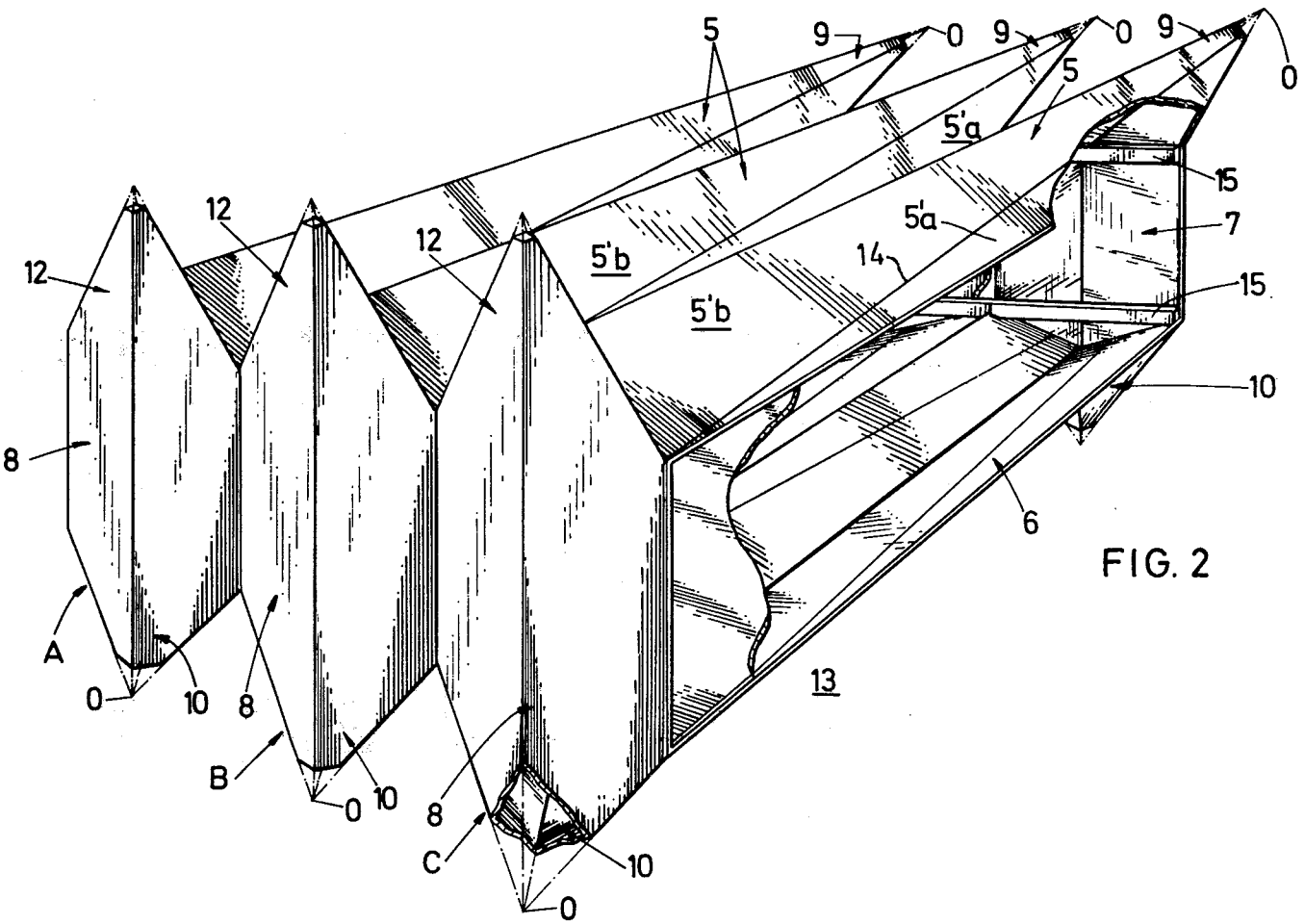
Figure 3:
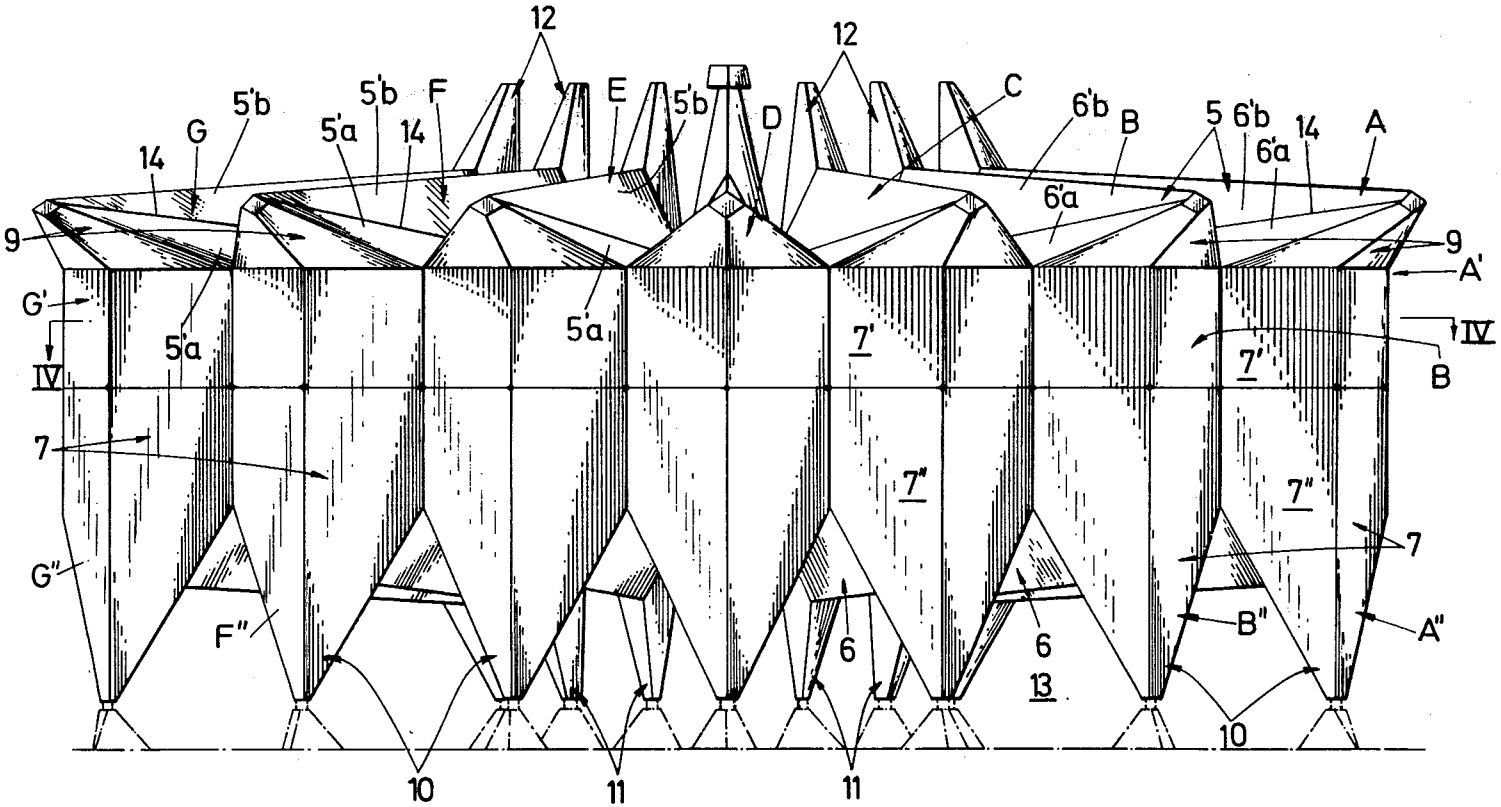
Figure 4:
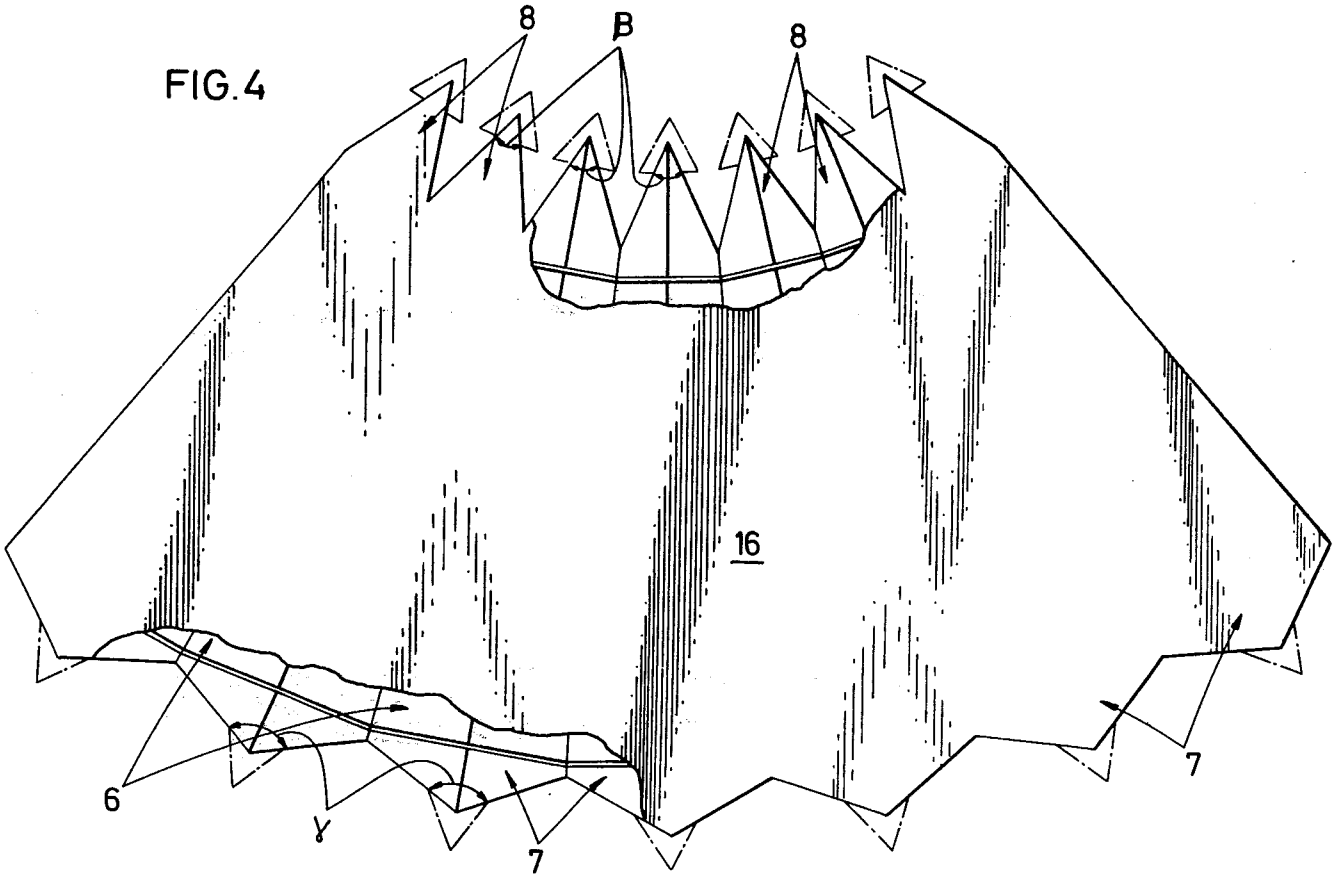
FIG. 4 shows diagrammatically a plan view along line IV—IV, of the prefabricated structure shown in FIG. 3.
Figure 5:
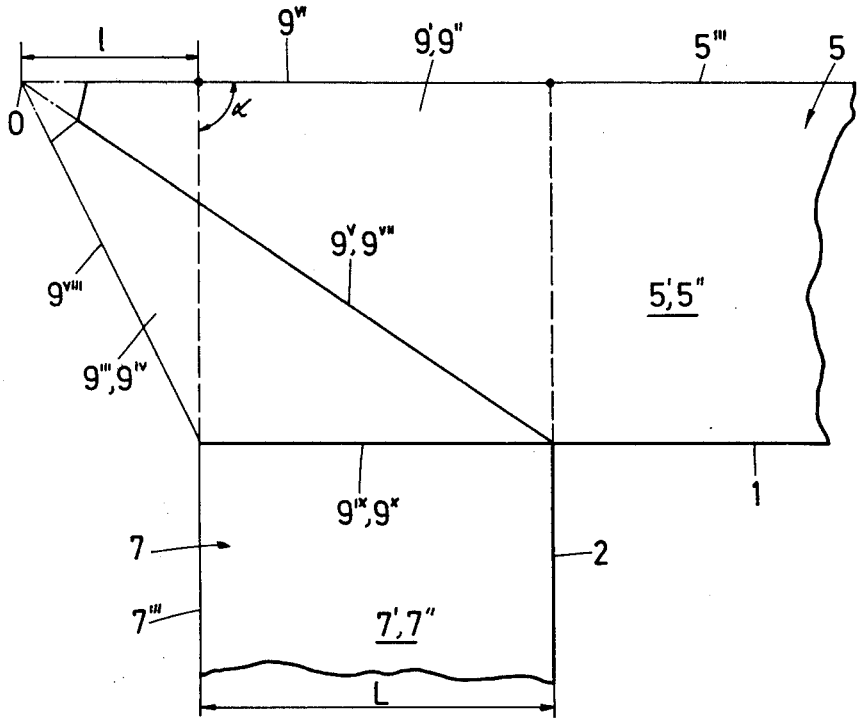
FIGS. 5 and 6 are diagrammatic elevation views of the geometry of one of the junction areas of a bay, respectively in the reduced-volume condition and in the extension condition.
Figure 6:
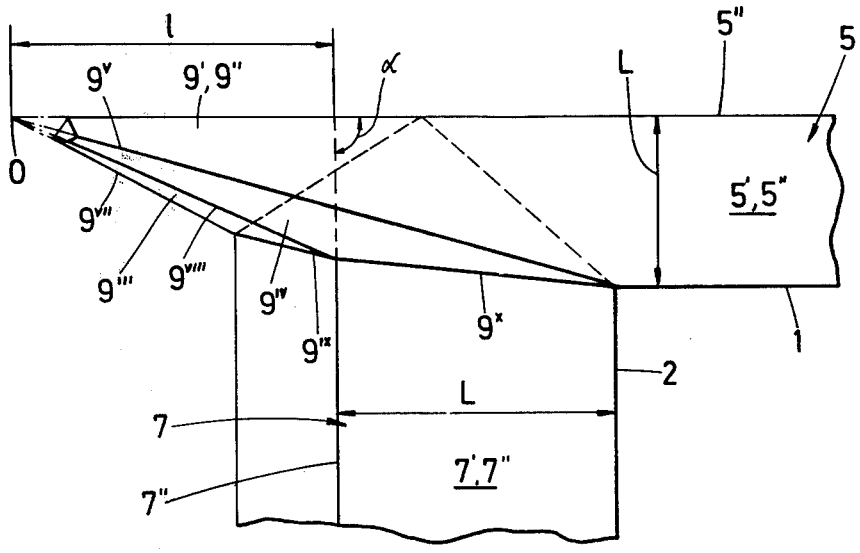
Figure 7:
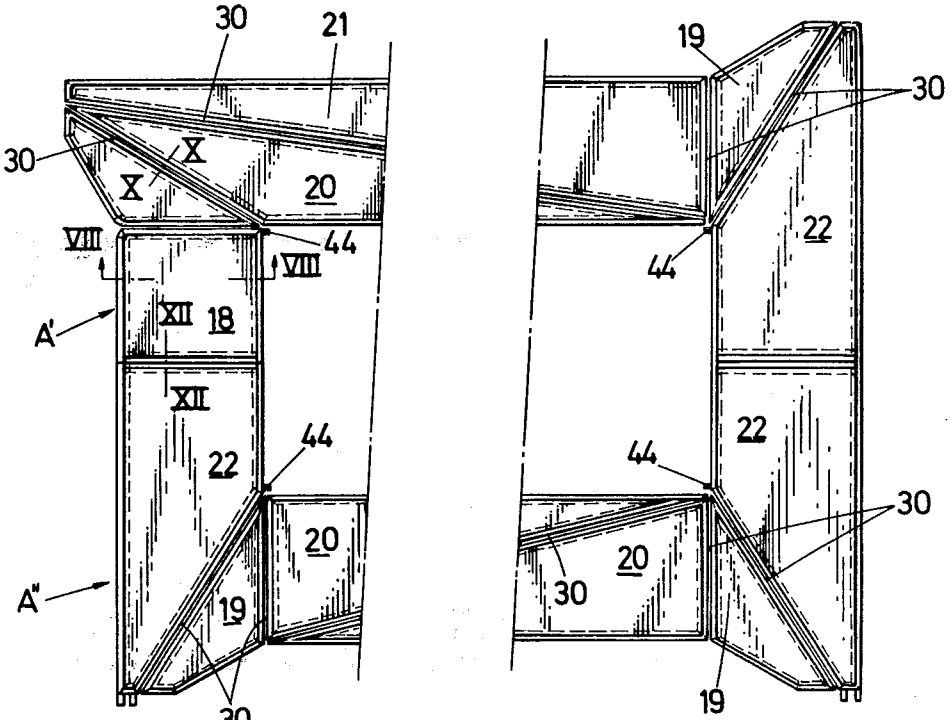
FIG. 7 is a diagrammatic elevation view with parts broken away and in the reduced-volume condition, of a series of bays assembled according to a first practical embodiment of the invention.

An essential feature of the invention lies in the apex O of each junction area lying outside the fictitious right angle X (see FIGS. 5 and 6) formed by the intersection lines $5^{III}$, $7^{III}$ of the two dihedrons concerned by the junction area. This feature has for advantageous result that the structure may change from the reduced-volume condition in which the sides of dihedrons 5 to 8 are substantially folded back on one another, to an extension condition in which the opening angle of the dihedrons is larger than 90° which results in an extension in the range from 60 to 85%. An additional advantage lies on the one hand in the fact that the sides part of the junction areas may be made from a rigid material similar to the one of the dihedron sides and on the other hand in the possibility by varying the arrangement of the junction areas, of changing the outer look of the building. As shown in FIGS. 1 to 3, those junction area lying at the level of the underflooring 10, 11 are generally directed with the apex thereof towards the ground so as to comprise pylons or legs supporting the structure above the ground to obtain an area 13 used as parking, playground or commercial zone. At the top of the structure, the junction area may have the apexes or points thereof directed in the extension of the dihedron 5 comprising the under-roofing (junction areas 9 in FIGS. 1 to 3) or in the extension of one of the dihedrons 7, 8 comprising the frontages (area 12 in FIGS. 1 to 3).

Another very useful advantage of the structure according to the invention lies in that the bays hingedly assembled may produce a curved building, that is covering on the ground a ring-like surface. This has been shown in FIGS. 3 and 4. In such a building the opening angle $\beta$ of the one dihedron 7 forming the frontage of each element, is smaller than the opening angle $\gamma$ of the opposite dihedron 8 forming the frontage. In a curved structure of this kind, it is useful to arrange the junction areas 12 located on the side of the small angles $\beta$ in the extension of the frontage dihedrons 8 so as to avoid areas engaging together and to provide a passage for the daylight towards the frontage portions 8. To erect curved structures, it is necessary according to the invention, to make the sides 5', 5'' and 6', 6'' of dihedrons 5, 6 forming the roof and underflooring as two triangular segments 5'a, 5'b, 5''a, 5''b, 6'a, 6'b, 6''a and 6''b hinged together along the adjacent edge 14 thereof which extends diagonally through the dihedron side. In FIG. 2 corresponding to a view on the side of arrow 15 in FIG. 1, there has been shown the forming in two parts of the dihedrons 5, 6 for the roof and underflooring to show clearly the structure and because nothing does prevent using such embodiment for straight structures.

According to an important feature of the invention, the sides of the roof dihedron 5, the underflooring dihedron 6 and the frontage dihedrons 7 and 8 the same width L and the locus of the apexes O of the junction areas is located at a distance "l" from the apex of angle $\phi$ which is substantially equal to half the width L.

According to another important feature of the invention, the structure described is completed after erecting the unit elements A, B, C, . . . on the building erecting site, by angle stabilizers 15. Said stabilizers 15 are comprised of cross-beams with a suitable cross-section, fastened inside the volume bounded by dihedrons 5 to 8 at the level of the intersection of the horizontal hinging lines 1, 3 and vertical hinging lines 2 4 of the bays A, B, C, . . .

To reduce the volume to be conveyed, it is desirable according to the invention, to design the structure vertically as two parts to be assembled on the erecting site as shown in FIG. 3. The one part is comprised of the hinged assembly A', B', C', of the top portion of bays A', B', C', . . . which top portion comprises the roof dihedrons 5 and a portion of the frontage dihedrons 7', 8'. The other part is comprised of the hinged assembly of the lower portion A'', B'', C'', of the bays A, B, C, which lower portion comprises the underflooring dihedrons 6 and a portion of the frontage dihedrons 7'', 8''.

After erecting and fastening the stabilizers 15, the building is provided with facing panels among which have been shown the ground panels 16 and the wall panels 17 in FIGS. 1 to 4.

In the above description no details have been given regarding the making of the surfaces of the dihedrons and corner zones. Practically, some of the sides or surfaces have openings for the mounting of windows and doors.

There will now be described with reference to FIGS. 7 to 14, a first practical embodiment of the structure according to the invention.

The structure described forms after erecting, a monocoque unit. It does comprise a series of panels from a rigid material, for instance polyester, bakelized wood, marine wood, which are assembled together along their adjacent edges by means of flexible sectional shapes, for instance from stainless steel which allow the relative hinging of the panels.

There is manufactured industrially a series of panels such as 19 to 22 with an outline which corresponds to the surface or surface portion formed in the structure by said panels after assembly thereof. Consequently, the panels 18 to 22 form after assembly the surfaces of the frontage dihedrons 7, 8; the panels 19 form after assembly the surfaces $9^{III}$, $9^{IV}$ of the polyhedrons in the junction areas; the panels 20 and 21 form after assembly, a triangular portion 5'a, 5'b, 6'a, 6'b of the roof dihedrons 5 and the underflooring dihedrons 6 as well as a portion of polyhedron surface in the junction areas, which is located in the same plane as the surfaces 5, 6 of the roof and underflooring dihedrons; finally the panels 22 form after assembly a portion of the surfaces 7, 8 of the frontage dihedrons and one surface or side [I], [II], of the polyhedrons in the junction areas which is located in the same plane.

Figure 11:
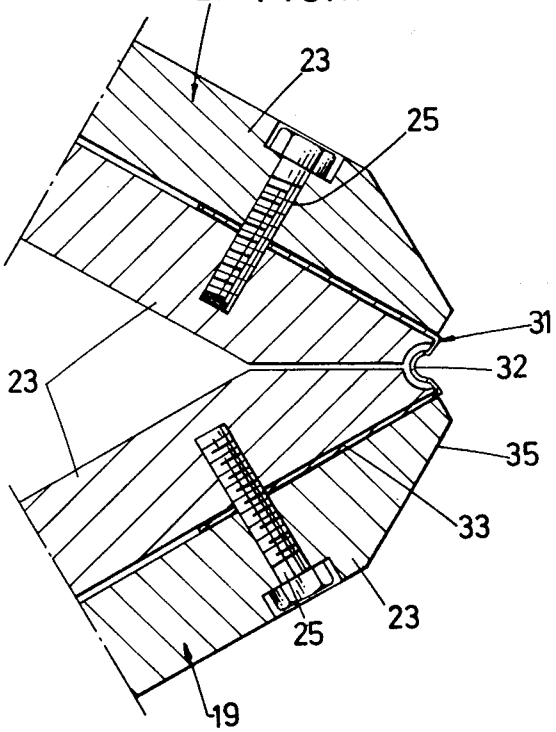
FIGS. 10 and 11 are diagrammatic cross-section views on a larger scale along line X—X in FIG. 7, respectively in the reduced-volume condition and in the extension condition, through two adjacent panels located substantially in the same plane when in the reduced-volume condition.
Figure 15:
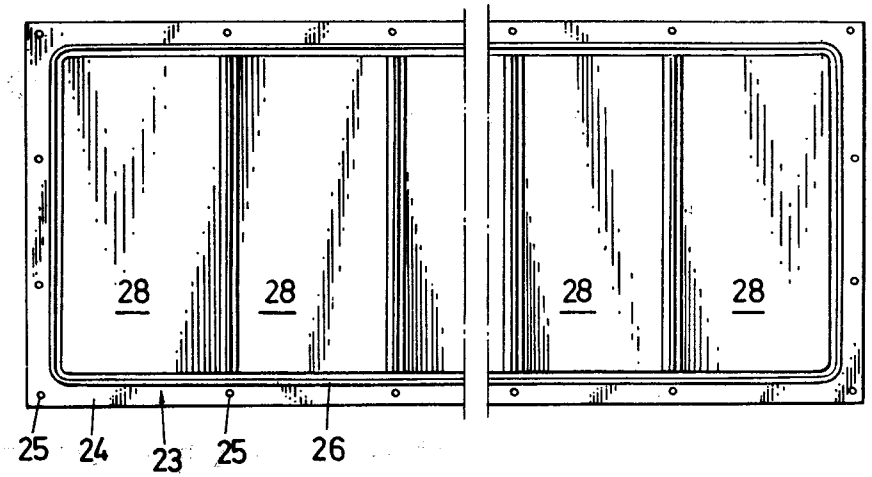
FIG. 15 is a plan view of half the shell of a panel used in the structure according to FIGS. 7 to 12.

The panels are for example comprised of two half-shells 23, one of which is shown in FIG. 15. Said half-shells each have an assembly rim 24 with holes 26, an inner circumferential groove 25 for receiving a gasket 27 and a series of recesses 28 for receiving an isolation such as mineral wool 29. The half-shells are assembled by means of bolts 25 and they are provided during the assembly, with the sectional shapes for hinged connection, which are of two types as described with more details hereinafter. Depending on the type of hinging profile they form, the edges 35, 36 of the half-shells have a different chamfer (compare FIGS. 10, 11 of FIGS. 8, 9); the chamfers end in a rounded groove 34. The first sectional shape type 31 shown in FIG. 14 and in FIGS. 10 and 11 is suitable to connect two panels such as 19 and 20, which lie in the reduced-volume condition of the structure shown in FIG. 7, in one and the same plane and which are thus not bent relative to one another. The sectional shape 31 has a rounded center head 32 which is joined to two flanges 33. The rounded head is received in the outer circumferential groove 34 and the flanges 33 of the sectional shapes 31 are received during the assembly between the edges 24 of the half-shells 23 and fastened by means of bolts 25, in such a way that when bending, the head 32 will lie on the structure inner side.

Figure 8:
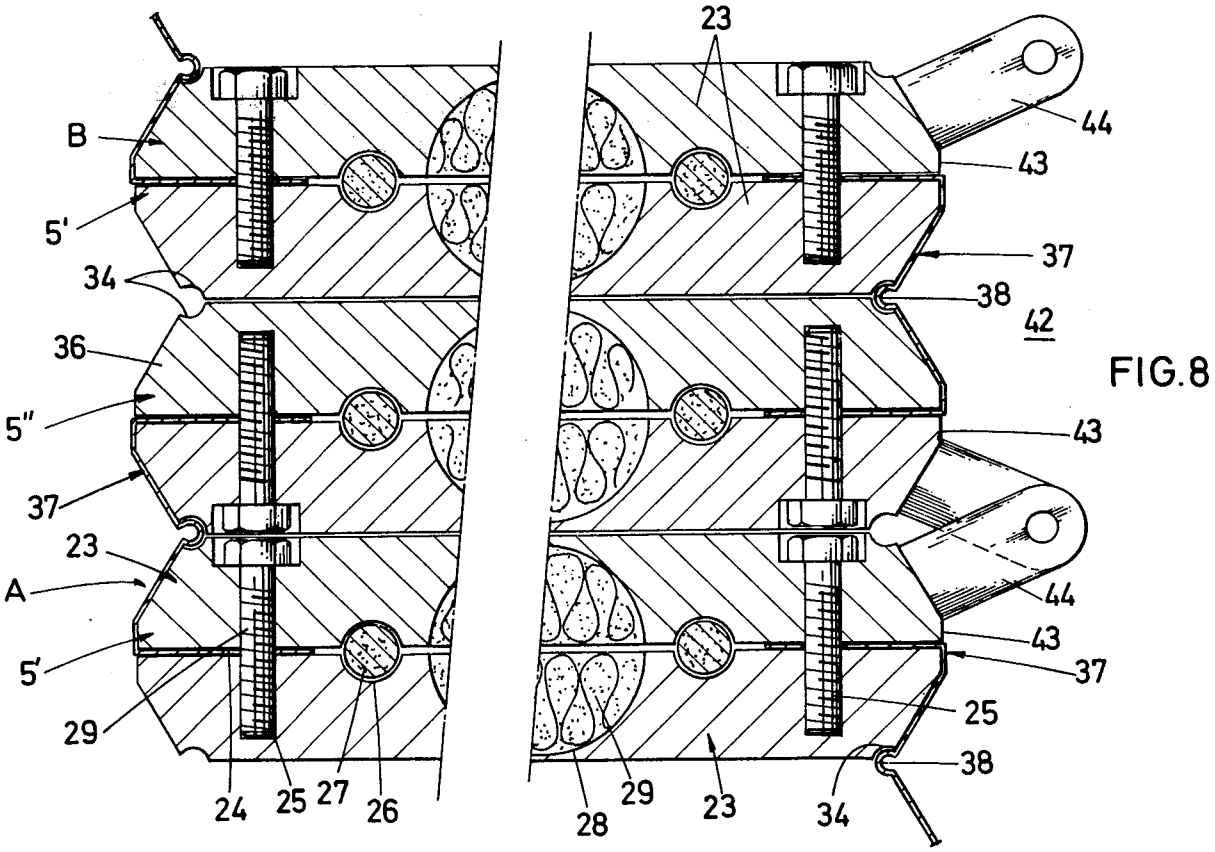
FIGS. 8 and 9 are diagrammatic cross-section views on a larger scale along line VIII—VIII in FIG. 7 of one and a half bay, respectively in the reduced-volume condition and in the extension condition.
Figure 9:
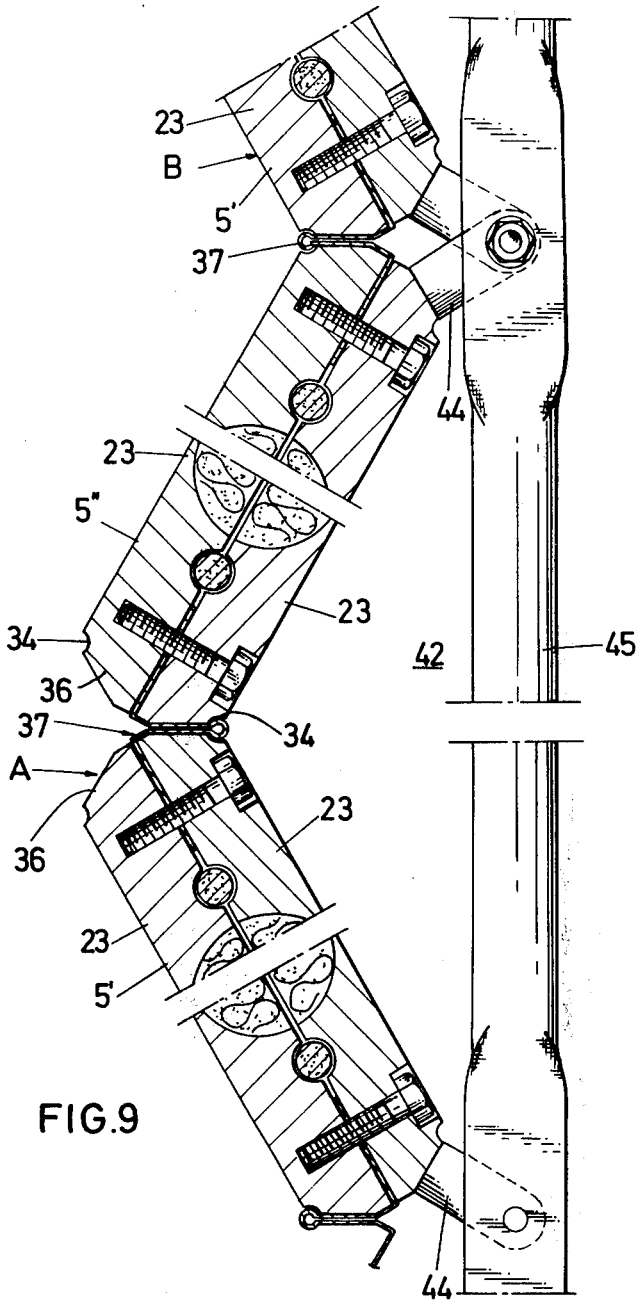
Figure 10:
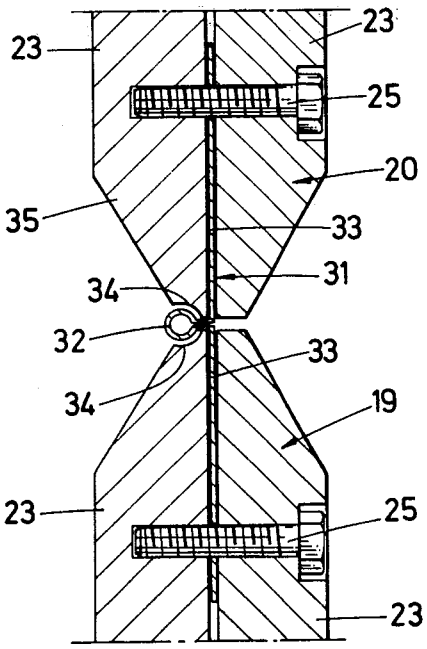
Figure 13:
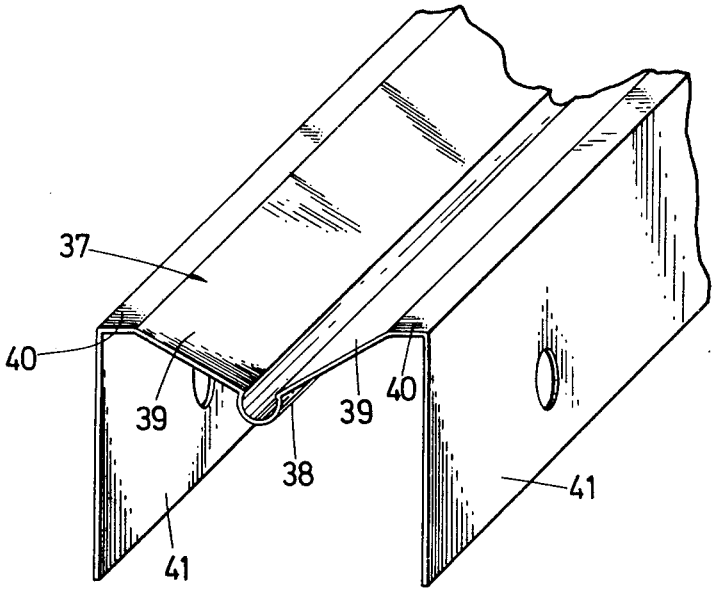
FIGS. 13 and 14 are respective views of two types of sectional shapes used in the structure according to FIGS. 7 to 12.
Figure 14:
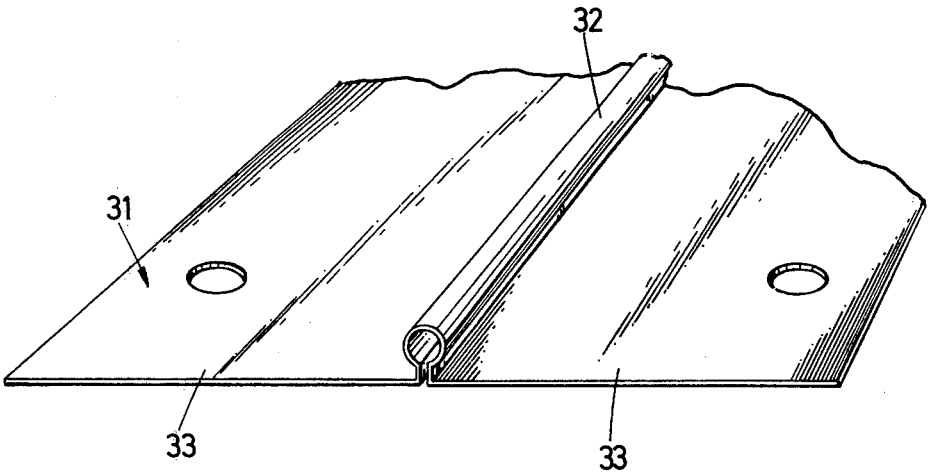
Figure 16:
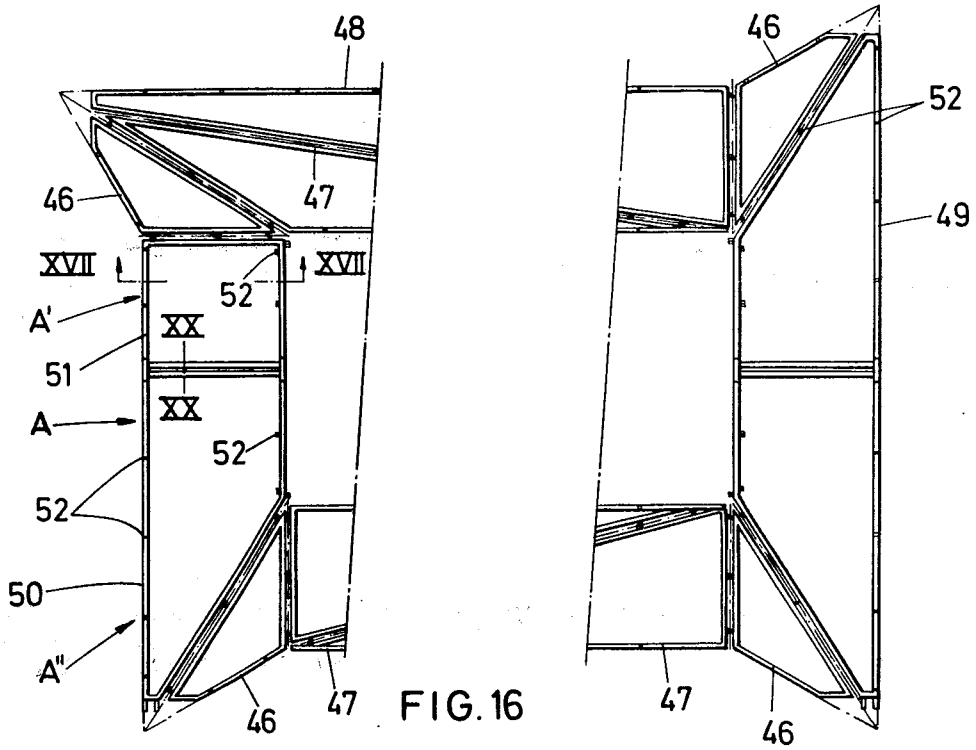
FIG. 16 is a diagrammatic elevation view in the reduced-volume condition, of the skeleton of a series of assembled bays, according to a second embodiment of the invention.

The second sectional shape type 37 shown in FIG. 13 and in FIGS. 8 and 9 has a rounded center head 38 on either side of which extends an upwards-slanted surface 39 which is connected by a straight portion 40 to a vertical flange 41, when considering the sectional shape position shown in FIG. 13. Said sectional shape 37 is used both to assemble those panels forming both sides of dihedrons 5 to 8 for one and the same unit element A, B, C . . . of the structure, the sectional shape forming in such a case the intersection lines 5''', 6''', 7''', 8''', and to assemble the adjacent panels in adjacent bays AB, BC, . . . , the sectional shape forming in such a case the junction lines of edges 1 to 4. The sectional shapes 37 are assembled together with the half-shells 23, the flanges 41 of said sectional shapes being retained between the assembly edges 24 of the half-shells 23 and fastened by means of common bolts 25 while the head 38 thereof is received in the rounded grooves 34 of the adjacent half-shells 23.

The half-shells 23 which are located after assembly in the panels 18, 22, on the inner side 42 of the building, bear on that edge 43 thereof opposite the leg provided with a connecting section 37, a lug 44 for the fastening of a stabilizing cross-beam 45 which is made for instance from a tube flattened in the zones fastened to the lugs 44.

Figure 12:
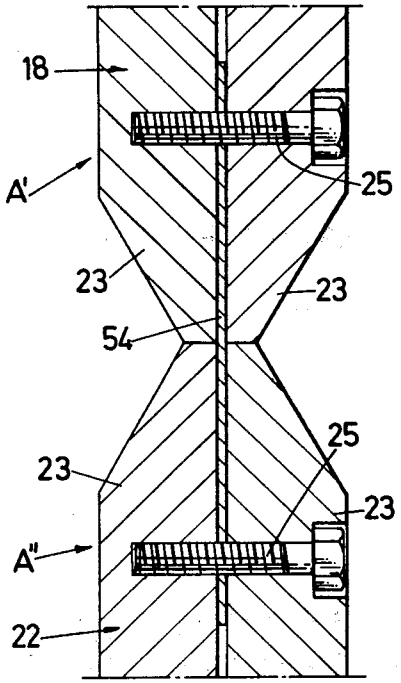
FIG. 12 is a cross-section on a larger scale along line XII—XII in FIG. 7.

Finally in FIG. 12 has been shown in which way both parts, the top one A' and the lower one A'', are assembled. The chamfered edges of the panels are superposed and a flat section 54 fastened by means of bolts 25 insures an accurate alinement thereof.

Instead of the connecting sections 31, 37, it is possible to use flat sections having a center position which bends either by the assembly with the half-shells or by the structure extension on the erecting site.

There will now be described with reference to FIGS. 16 to 20 a second practical embodiment of the structure according to the invention.

Figure 17:
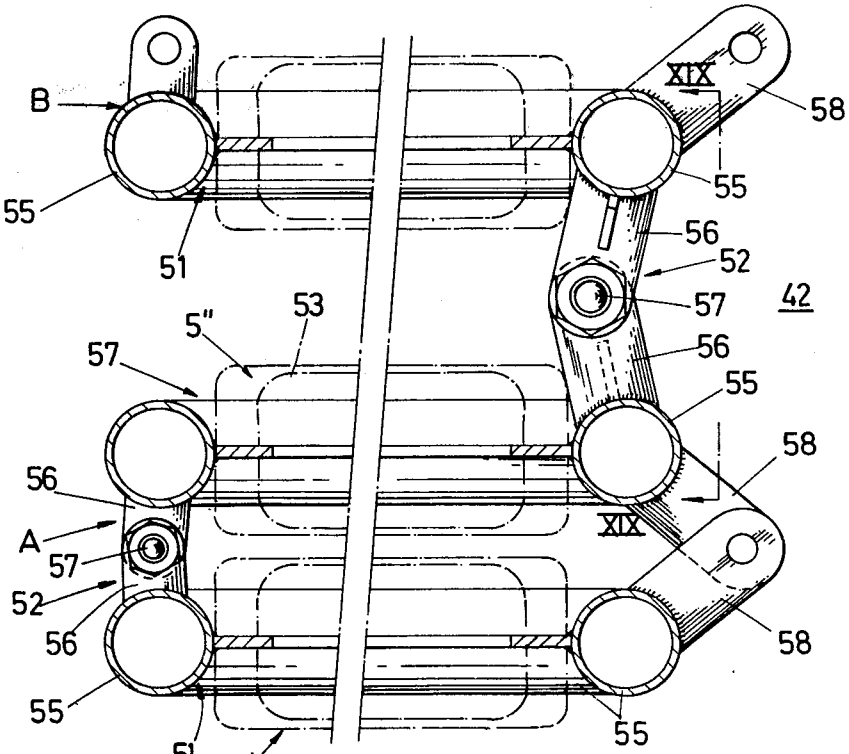
FIGS. 17 and 18 are diagrammatic cross-section views on a larger scale along line XVII—XVII in FIG. 7, of one and a half bay, in the reduced-volume condition and in the extension condition.
Figure 18:
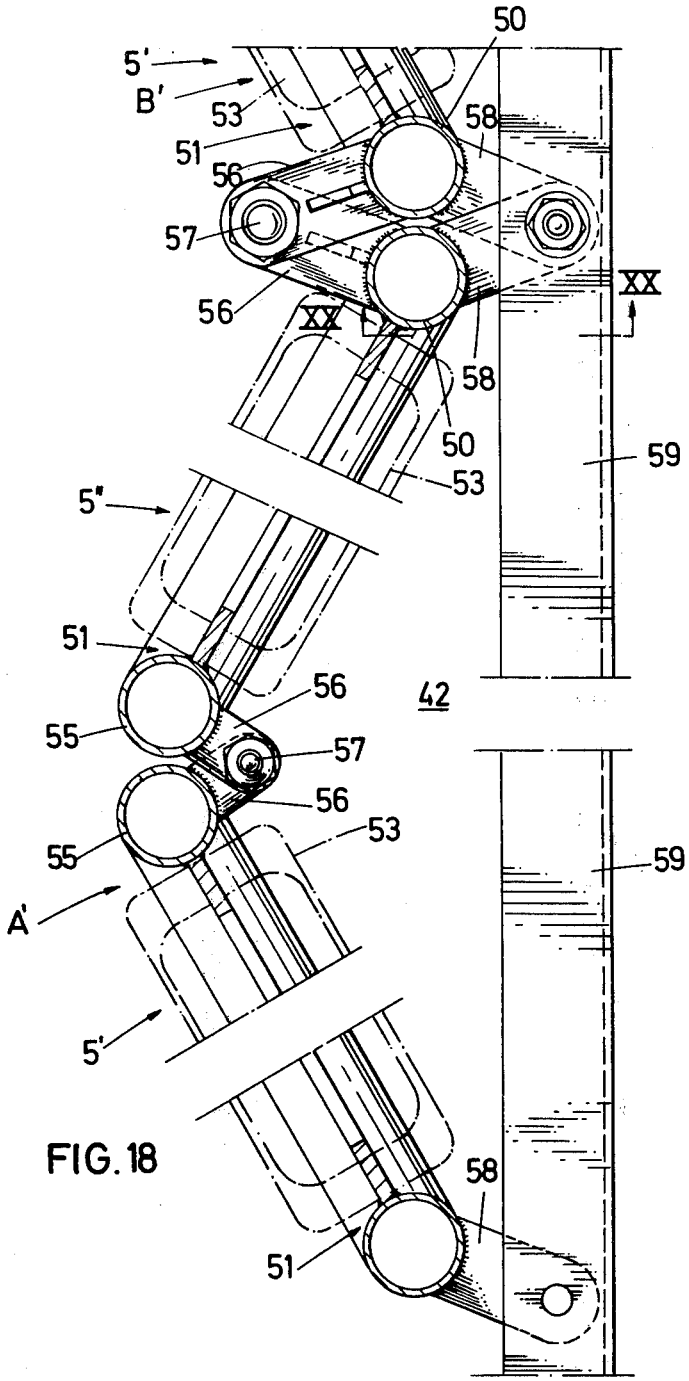
Figure 21:
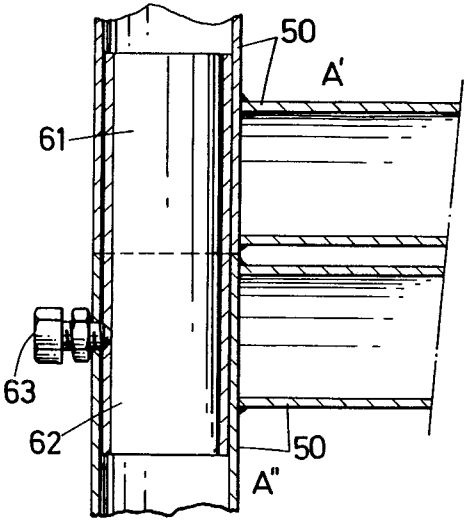
FIG. 21 is a cross-section view along line XXI—XXI in FIG. 16.

In this second embodiment, the structure is formed on the one hand by a series of skeleton frames 46 to 51 assembled together by means of hinges 52 and on the other hand by filling panels 53 shown in dotted lines in FIGS. 17 and 18. The frames 46 to 49 have an outline which corresponds for each one of the circumference of the side to be formed and they are made from a soldered arrangement of tubes 55. The hinges 52 have lugs 56 fastened projectingly at intervals on tubes 50, the lugs 56 on adjacent frames being bolted in the selected angular position by means of bolts 57. It will be noticed that the lugs 56 of the hinges between the frames of adjacent unit elements sides, elements A, B in the figures, are longer than the hinging lugs between the frames of sides 5', 5'' belonging to the same bay, A for example.

Figure 20:
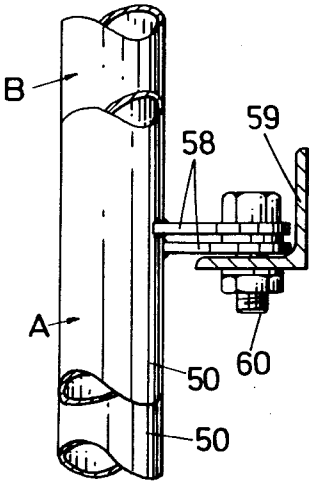
FIG. 20 is a simplified cross-section view along line XX—XX in FIG. 18.
Figure 19:
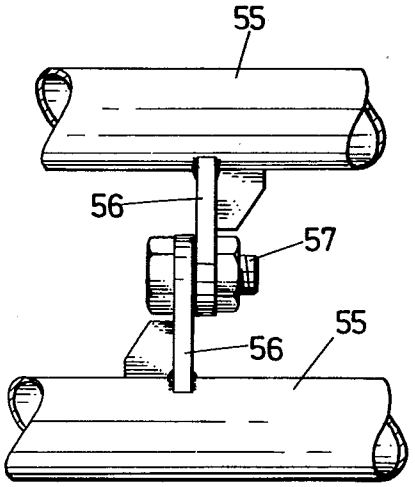
FIG. 19 is a part end view along line XIX—XIX in FIG. 17.

The tubes 55 arranged after assembly of the frames on the building inner side 42, bear at the top end thereof for the frames which are to form the structure top part A', B' and at the lower end respectively for the frames which are to form the structure lower part A'', B'', a lug 58 for the fastening of the structure stabilizing cross-beams shown in 59. As shown in FIG. 20, the cross-beam 59 is comprised of a bracket and it is fastened to the lugs 58 by means of bolts 60.

Finally for joining the top part A', B', . . . and the lower part A'', B'', . . . of the structure, there have been provided sleeve 61 which are fixedly mounted inside the vertical tubes 50 of the top part frames 49, 51, and provided with a projecting portion 62 which fits inside the vertical tubes 50 of the lower part vertical tubes 52, 49 to be fastened therein by clamping screws 63.

It must be understood that the invention is in no way limited to the above embodiments and that many changes can be brought therein without departing from the scope of the invention as defined by the appended claims.

I claim:

1. Prefabricated structure for erecting a building, that comprises bays hinged together which can take a position with a reduced volume and a position of extension, in which each bay comprises in the structure erecting condition and from the geometrical point-of-view, two pairs of dihedrons facing one another by pairs and comprising respectively the roof, the underflooring and the frontages of the bay, each dihedron comprising two sides hinged together along the dihedron intersection line and the junction areas between the dihedrons are each comprised of a truncated polyhedron comprising four side surfaces hinged together along their converging edges, said edges converging towards an apex located outside the imaginary right angle between the intersection lines of two dihedrons, two of those edges opposite the converging edges of the polyhedron being hingedly joined to one of the dihedrons, the structure further comprising means for stabilizing the dihedron angles in the bay extension condition, and the succeeding bays being hingedly connected together along the adjacent circumferential edges thereof.

2. Prefabricated structure as defined in claim 1, in which the dihedron sides have the same width and the locus of the junction area apexes is located in the reduced-volume condition of the structure, at a distance from the imaginary intersection point between the intersection lines of both dihedrons, which is substantially equal to half the width of the dihedron sides.

3. Prefabricated structure as defined in claim 1, which comprises two complementary separate parts that comprises in turn, the one a plurality of bays hinged together, each bay having one dihedron to form the roof and two facing dihedrons to form frontage portions as well as said junction areas, and the other part a plurality of bays hinged together each one of which has a dihedron to form the underflooring and two facing dihedrons to form frontage portions as well as said junction areas, the frontage portions of each structure part having a height which is equal to a fraction of the total frontage height and said portions comprising means to connect same together.

4. Prefabricated structure as defined in claim 1, in which said means for stabilizing the dihedron angles in the bay extension condition, comprise cross-beams connected together which are mounted inside the volumes bounded by the dihedrons at the level of the intersection of the hinging lines between adjacent bays.

5. Prefabricated structure as defined in claim 1, in which the polyhedron bounding the junction area comprises on the one hand, two side surfaces each lying in the same plane as one side of one dihedron bounding the roof, the frontage portion and the underflooring and extending said dihedron sides without discontinuity and on the other hand two sides each lying in a plane cross-wise to the plane of the one side of the second dihedron concerned by the corresponding junctions area and which sides are hinged relative to said second dihedron sides.

6. Prefabricated structure as defined in claim 5, in which the junction areas connecting the underflooring to the frontages form legs or pylons for heightening the underflooring, the dihedron sides bounding the frontage portions being extended without discontinuity by two side surfaces of that polyhedron bounding the junction area.

7. Prefabricated structure as defined in claim 1, in which in the extension condition, the angles of those dihedrons forming the frontage portions of one end the same bay are not equal to one another so as to form a curved structure.

8. Prefabricated structure as defined in claim 1, in which the sides of thos dihedrons forming the roof and underflooring are comprised of two triangular segments hingedly connected together along the one side thereof, running in parallel relationship and extending diagonally through the dihedron side.

9. Prefabricated structure as defined in claim 1, in which the dihedron and polyhedron sides are comprised of rigid panels and said panels are connected together along the adjacent edges thereof by means of flexible connecting sectional shapes, the panels and the connecting sectional shapes forming a monocoque structure.

10. Prefabricated structure as defined in claim 9, which comprises two types of connecting sectional shapes, a first type to connect panels which in the reduced-volume condition of the structure lie substantially in the same plane and a second type to connect panels which in the reduced-volume condition of the structure lie substantially one against the other, both types of sectional shapes having a center portion which is curvable and located between said panels, and two flanges located on either side of the center portion to fasten the sectional shape to the panels.

11. Prefabricated structure as defined in claim 9, in which each panel is comprised of two half-shells from rigid synthetic material, each half-shell having along the outline thereof a rim for the assembly together by means of assembly members, the half-shells having an inner circumferential groove for receiving a gasket and a series of recesses for receiving a heat-isolation material, the connecting sectional shapes being sandwiched with their fastening flanges between the assembly rims of the half-shells.

12. Prefabricated structure as defined in claim 1, which comprises a series of skeleton frames bounding the circumference of the dihedrons and the polyhedrons and the polyhedron sides, rigid panels for filling said frames as well as members for hingedly connecting the frames together.

13. Prefabricated structure as defined in claim 12, in which the frame series comprises frames having a rectangular shape corresponding to a dihedron side, other frames having a triangular shape corresponding to a polyhedron side, other frames having a polygonal shape corresponding to a dihedron side and at least one polyhedron side extending without discontinuity said dihedron side, and still other frames having a triangular shape corresponding to a dihedron side seqment.

14. Prefabricated structure as defined in claim 12, in which the skeleton frames for the sides of the one dihedron pair have on the edge thereof opposite that edge facing the dihedron intersection line, lugs projecting inside the volume bounded by said structure, the stabilizing cross-beams being made fast to said lugs.

* * * * *